US007718034B2

(12) United States Patent
Vaders

(10) Patent No.: US 7,718,034 B2
(45) Date of Patent: May 18, 2010

(54) REFINER STEAM SEPARATION SYSTEM FOR REDUCTION OF DRYER EMISSIONS

(75) Inventor: Dennis Henry Vaders, Elkin, NC (US)

(73) Assignee: Masonite Corporation, Tampa, FL (US)

( * ) Notice: Subject to any disclaimer, the term of this patent is extended or adjusted under 35 U.S.C. 154(b) by 28 days.

(21) Appl. No.: 12/103,951

(22) Filed: Apr. 16, 2008

(65) Prior Publication Data

US 2008/0202713 A1 Aug. 28, 2008

Related U.S. Application Data

(62) Division of application No. 10/845,480, filed on May 14, 2004, now Pat. No. 7,368,037.

(60) Provisional application No. 60/471,910, filed on May 21, 2003.

(51) Int. Cl.
*D21B 1/12* (2006.01)

(52) U.S. Cl. ..... 162/23; 162/234; 162/232; 162/243; 162/21; 241/49; 241/28

(58) Field of Classification Search ..... None
See application file for complete search history.

(56) References Cited

U.S. PATENT DOCUMENTS 4,298,425 A * 11/1981 Ranzen et al. ..... 162/18
5,034,175 A * 7/1991 Safstrom ..... 264/120
6,464,826 B1 * 10/2002 Safstrom et al. ..... 162/23

* cited by examiner

*Primary Examiner*—Mark Halpern
(74) *Attorney, Agent, or Firm*—Berenato & White, LLC

(57) ABSTRACT

A refiner steam separation system according to the present invention includes a blowline for transporting a mixture of fiber material from a refiner to an inlet of a steam separator. Waste steam is discharged from the separator through a waste steam outlet. Cleaned fiber material is discharged from the separator through an exit, which prevents a substantial portion of the waste steam from passing through the exit. A relay pipe communicates with the exit and a dryer duct, and transports cleaned fiber material therebetween. A resin input communicates with the relay pipe, and supplies resin therein. The resin is mixed with the cleaned fiber material prior to the cleaned fiber material being dried in the dryer duct. The present invention is also directed to a method of reducing VOC emissions generated during refining cellulosic fibrous material.

15 Claims, 5 Drawing Sheets

REFINER STEAM SEPARATION SYSTEM FOR REDUCTION OF DRYER EMISSIONS

CROSS-REFERENCE TO RELATED APPLICATION AND CLAIM TO PRIORITY

This application is a divisional of application Ser. No. 10/845,480, filed May 14, 2004, now U.S. Pat. No. 7,368,037 which is based on provisional application Ser. No. 60/471,910, filed May 21, 2003, for Dennis H. Vaders, the disclosures of which are incorporated herein by reference and to which priority is claimed.

FIELD OF THE INVENTION

The present invention is directed to a refiner steam separation system for refining cellulosic fiber material that adds resin to the fiber material after steam separation, achieves excellent blending of the fiber/resin mixture, and significantly reduces gaseous VOC emissions.

BACKGROUND OF THE INVENTION

Comminuted cellulosic fibrous material, such as slurried wood chips, may be refined in one or more refiners for producing pulp for use in fiberboard and the like. Process steam is inherently generated during the refining process, forming a mixture of mechanical pulp and process steam. In addition, it is sometimes desirable to add resin to the mixture. Therefore, some refining systems include feed lines for adding resin. After comminution and the addition of resin, the mixture is generally dried in a fiber dryer, such as a flash tube fiber dryer.

During the manufacture of the pulp, gaseous volatile organic compounds (VOCs) are generated and emitted. Emissions from fiber dryers contain relatively high levels of VOCs, which may be above acceptable emission levels pursuant to Federal Maximum Achievable Control Technology (MACT) regulations. In addition, VOC levels may be high if resin is added after refining because many resins, such as urea formaldehyde based resins, release VOCs and other impurities after the refining process. The prevalent control technology for reducing emissions to VOC compliance levels is a regenerative thermal oxidizer (RTO). However, RTOs typically have high capital costs and operating costs due to the relatively large volume of dryer exhaust that must be treated.

In an attempt to reduce dryer exhaust emissions, some refiner systems separate the steam from the fiber before the fiber enters the dryer. It is well known that the steam carrying the wood fiber from the refiner to the dryer contains a relatively large percentage of the VOC emission components. Thus, various attempts have been made to provide an efficient system employing steam separation for reducing VOC emissions.

A cyclone is a common means of separating a solid material being conveyed by a gas. Some refining systems use a pressurized cyclone for separating the fiber from the steam. The separated steam generated in the cyclone may be condensed, cleaned using scrubbers, or processed using some other means known in the art. The fiber is then transported to a dryer. Ideally, a relatively high percentage of the "dirty" steam (i.e. steam containing VOCs and other impure emission components), for example 75% or more, would be removed from the fiber. However, the current separators used in conventional systems do not attain such levels of separation.

Furthermore, many pressurized cyclones and some pressurized separators use a percentage of the steam from the refiner to move the fiber to the dryer. Thus, a sufficient amount of dirty steam is required to carry the fiber to the dryer. This limits efficiency, given a relatively large portion of dirty steam is generally required to transport the fiber to the dryer.

In an attempt to reduce the percentage of dirty steam used for transporting the fiber, some systems add additional "clean" steam to the fiber prior to steam separation. Although emissions may be slightly reduced, such systems are inefficient because excessive quantities of clean steam must be provided. Furthermore, such systems may still fail to achieve acceptable VOC emission levels.

Other systems use a non-pressurized cyclone for steam separation. A higher percentage of steam separation is typically achieved compared to pressurized systems. Non-pressurized systems are more effective at separating the steam, because at ambient pressures the steam has maximum volume and less steam will be carried out of the cyclone in voids between the fibers. Also, more of the water and VOCs will be in vapor form at lower pressures. Such conventional systems typically provide that the fiber is mixed with the resin prior to steam separation. The mixture then undergoes steam separation, after which the fiber empties directly from the separator into the dryer. Although non-pressurized systems are effective at separating steam, such systems typically fail to achieve adequate blending between the resin and fiber. Furthermore, fiber clumping, wherein the fiber lumps or balls, is prevalent in such systems, particular when the fiber exits from the cyclone directly into the dryer. Furthermore, such systems often cause resin spotting on the fibers due to inadequate dispersal of the mixture upon entering the dryer.

Additional problems and/or concerns must be addressed when resin is added to the fiber/steam mixture. Some resins, such as urea formaldehyde based resins, are typically added to the fiber/steam mixture prior to steam separation because such resins release VOCs, such as formaldehyde, during processing. In this way, VOCs emitted may be separated and processed along with the dirty steam. However, the addition of resin to the mixture upstream of the cyclone tends to clog the cyclone. Resin build-up must be periodically removed from the cyclone. This increases manufacturing cost.

In an attempt to eliminate problems associated with resin build-up in the cyclone, some systems add resin to the fiber after steam separation. However, if resins that emit relatively high levels of VOCs are used, the resulting VOC emission levels may also be relatively high (i.e. beyond the acceptable MACT regulations). In addition, it has proven difficult to achieve adequate blending of the resin with the fiber material when resin is added downstream of the separator in non-pressurized systems. Such atmospheric systems often result in fiber clumping and/or resin spotting on the product, as noted above. Some pressurized systems may achieve sufficient blending, but require that a percentage of dirty steam from the refiner continue into the dryer with the fiber. Thus, efficiency and effectiveness are reduced.

Therefore, most current refining/drying systems add resin in the line from the refiner to the separator to achieve adequate blending, at the cost of resin build-up problems noted above.

Therefore, there is a need for a fiber refiner steam separation system that is efficient and relatively low cost. The system must also provide for excellent blending of the fiber/resin mixture, and substantially reduce VOC emissions, preferably by at least about 75%.

SUMMARY OF THE INVENTION

The present invention is directed to a refiner steam separation system for refining cellulosic fiber material that adds resin to the fiber material after steam separation, achieves excellent blending of the fiber/steam and resin mixture and substantially reduces VOC emissions, preferably by at least about 75%.

A refiner steam separation system according to the present invention includes a blowline for transporting a mixture of fiber material and a steam separator. The fiber material and steam is supplied to the steam separator through an inlet on the separator. Waste steam is discharged from the separator through a waste steam outlet. Cleaned fiber material is discharged from the separator through an exit, which prevents a substantial portion of the waste steam from passing therethrough. A dryer duct is operably associated with a dryer for drying the cleaned fiber material. A relay pipe communicates with the exit and the dryer duct, and transports cleaned fiber material therebetween. A resin input communicates with the relay pipe, and supplies resin therein. The resin is mixed with the cleaned fiber material prior to the cleaned fiber material entering the dryer duct.

In one embodiment, the steam separator is a non-pressurized cyclone with an airlock. The fiber is transported from the cyclone to a dryer using a relay system. The relay system may include a high-pressure pneumatic blower system, steam, a venturi system, or a combination thereof. Conditions in the relay system for blowing the fiber to the dryer are similar to conditions in the refiner blowline used to move the fiber in the refiner pipe to the cyclone. Resin is added to the fiber at a point downstream of the cyclone. Relocation of the resin feed pipe to a point downstream of the cyclone prevents resin buildup within the cyclone, which could otherwise result in product quality issues. Excellent blending is achieved by providing conditions in the relay system that are similar to those in the refiner blowline. A reduction in VOC emission levels, preferably of at least about 80%, is achieved when using resins that do not contribute to VOC levels.

In another embodiment, the steam separator may be either a pressurized cyclone or a non-pressurized cyclone operably associated with a plug screw feeder for discharging the fiber material into the relay system while preventing passage of substantially all of the dirty steam. Resin is added to the fiber at a point downstream of the separator. A reduction in VOC emission levels, preferably of at least about 80%, is achieved when using resins that do not contribute to VOC levels.

In another embodiment, the steam separator is a mechanical separator operably associated with a plug screw feeder. Resin is again added after steam separation. A reduction in VOC emission levels, preferably of at least about 80%, is achieved when using resins that do not contribute to VOC levels.

In another embodiment, a refiner system includes first and second cascading steam separators. The system includes a blowline for transporting a mixture of fiber material and steam. A first steam separator has a first inlet communicating with the blowline for receiving the mixture therefrom, a first waste steam outlet for releasing waste steam, and a first exit for discharging partially cleaned fiber material from the separator and for preventing a first portion of the waste steam from passing therethrough. A second steam separator has a second inlet, a second waste steam outlet for releasing waste steam, and a second exit for discharging cleaned fiber material from the separator and for preventing a second portion of the waste steam from passing therethrough. A dryer duct operably associated with a dryer dries the cleaned fiber material. A first relay pipe communicates with the first exit and the second inlet for transporting the partially cleaned fiber material therebetween. A second relay pipe communicates with the second exit and the dryer duct for transporting the cleaned fiber material therebetween. A resin input communicates with the second relay pipe and supplies resin therein. The cleaned fiber material and resin are thoroughly mixed prior to entering said dryer duct. Preferably, at least about 50% of the waste steam is removed during each separation stage, followed by the addition of an equivalent amount of clean steam at the relay pipe. A reduction in VOC emission levels, preferably of at least about 75%, is achieved when using resins that do not contribute to VOC levels.

A method of reducing volatile organic compound (VOC) emissions generated during refining cellulosic fibrous material is also disclosed. Fiber material is transported through a blowline at a first flow velocity to a steam separator. Cleaned fiber material is discharged from the separator into a relay pipe, while a substantial portion of waste steam containing VOCs is prevented from passing into the relay pipe. The cleaned fiber material is transported through the relay pipe at a second flow velocity while the cleaned fiber material is mixed with a resin having low levels of VOCs. The mixed cleaned fiber material and resin are dried in a dryer duct.

DETAILED DESCRIPTION OF THE INVENTION

Figure 1:
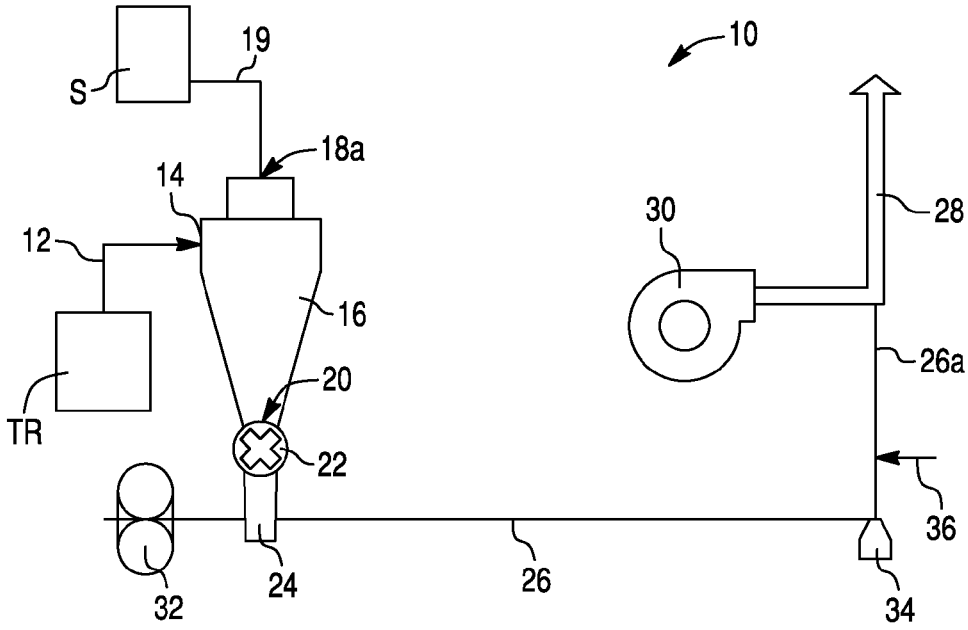
FIG. 1 is a schematic of a steam separation system according to a first embodiment of the present invention.

As best shown in FIG. 1, a steam separation system 10 according to a first embodiment includes a refiner blowline 12 for transporting a mixture of fiber material and process steam produced from a conventional refiner, such as a thermomechanical refiner TR. Blowline 12 is in communication with an inlet 14 of a steam separator 16. Separator 16 is preferably a non-pressurized separator, such as a non-pressurized cyclone. The mixture is transported from refiner TR through blow line 12, and supplied to separator 16 through inlet 14. Separator 16 separates the process steam, which contains VOCs, from the fiber material. The separated dirty steam is channeled out of separator 16 via a waste steam outlet 18 of separator 16. The waste steam may then be sent to a scrubber S for cleaning via associated piping 19 communicating with outlet 18 and scrubber S. The waste steam may also be sent to an incinerator, or condensed to liquid waste for disposal.

Separator 16 includes an exit portion 20, which is in communication with an airlock 22, such as a rotary airlock. Airlock 22 allows fiber to exit separator 16 through exit portion 20, but prevents a substantial portion of waste steam or gases from passing therethrough. A transition chamber 24 communicates with airlock 22 and a relay pipe 26, so that cleaned fiber material may be channeled through airlock 22 into relay pipe 26 via transition chamber 24.

Relay pipe 26 transports the cleaned fiber material supplied from transition chamber 24 to a dryer duct 28 for drying the fiber. Dryer duct 28 is operably associated with a dryer fan 30. Dryer fan 30 pushes or pulls hot air into dryer duct 28, as known in the art.

Preferably, air lock 22 prevents at least about 80% of the dirty steam, more preferably at least about 90%, from passing into transition chamber 24. Therefore, only a minimal amount of dirty steam is channeled from separator 16 into relay pipe 26. In this way, a substantial reduction in VOC emission levels is achieved, preferably by at least about 80%, more preferably by at least about 90%.

Any dirty steam that passes through airlock 22 into relay pipe 26 via transition chamber 24 is minimal. This minimal dirty steam, if any, passing into relay pipe 26 from transition chamber 24 is insufficient to transport the cleaned fiber material through relay pipe 26 to dryer duct 28. Therefore, system 10 may include a high power blower 32 for transporting the fiber material through relay pipe 26. Blower 32 is in communication with transition chamber 24, and supplies pressurized air or a combination of air and clean steam into transition chamber 24. The cleaned fiber is thereby forced into relay pipe 26. In this way, the cleaned fiber material is transported through relay pipe 26 to dryer duct 28. Clean steam may be readily available from a boiler associated with the refiner TR. Alternatively, the cleaned fiber material may be transported through relay pipe 26 using steam only, or a venturi system, or a combination of blower 26, steam, and a venturi system.

Preferably, high pressure blower 32 supplies air at a pressure of about 15 psi or less, given separator 16 is non-pressurized. If the pressure in transition chamber 24 greatly exceeds the pressure in separator 16, it may be difficult for the fiber material to exit separator 16 through airlock 22, since operating parameters of most conventional rotary airlocks have pressure constraints. Blower 32 preferably supplies hot air and/or steam at a temperature of at least about 200° F.

Preferably, the flow velocity within relay pipe 26 is at least about 125 feet per second. Flow velocity is the speed at which the fiber material is flowing through the subject pipe. Preferably, the flow velocity within relay pipe 26 is substantially the same as the flow velocity within blowline 12. Depending on the length and diameter of piping required for relay pipe 26, a steam nozzle 34 may be provided, which is in communication with relay pipe 26 downstream from transition chamber 24. Steam nozzle 34 maintains and/or increases the flow velocity of the cleaned fiber as it enters dryer duct 28. Thus, steam nozzle 34 may be needed if system 10 includes a relatively long relay pipe 26.

It should be understood that relay pipe 26 may have various dimensions depending on the configuration of the particular system, since pipe length and diameter will influence flow velocity and pressure. For example, relay pipe 26 may have a diameter of between about 3 inches to about 6 inches, depending on the particular system configuration. The precise configuration of relay pipe 26 is preferably adjusted so that the preferred pressure and preferred flow velocity is maintained in relay pipe 26. Pressure within relay pipe 26 is preferably sufficient to achieve a flow velocity of at least about 100 feet per second or more.

A resin line 36 communicates with relay pipe 26 downstream of transition chamber 24, preferably at a point intermediate steam nozzle 34 and dryer duct 28 if system 10 includes nozzle 34. The addition of resin at a point downstream from separator 16 eliminates problems attributable to resin build-up in separator 16. Resin line 36 supplies resin into relay pipe 26. The cleaned fiber material is thoroughly mixed with the resin prior to entering dryer duct 28. Preferably, the fiber/resin mixture travels through a portion 26*a* of relay pipe 26 having a sufficient length to allow the fiber/resin mixture to be thoroughly mixed prior to drying in dryer duct 28. For example, portion 26*a* may have a length of at least about 20 feet, more preferably at least about 30 feet, in an exemplary configuration of system 10. After the fiber and resin has been sufficiently mixed, it is dried in dryer duct 28.

Preferably, resin line 36 includes a pressurized nozzle for spraying liquid resin into relay pipe 26. Preferably, a phenolic resin, such as phenol-formaldehyde, or some other resin that emits relatively low levels of VOCs, is supplied to relay pipe 26 via resin line 36. Phenol-formaldehyde resin is not a high emitter of VOCs, and releases a relatively insignificant amount of VOCs, within the acceptable limits pursuant to current MACT regulations. Thus, almost all of the VOC emissions are generated in the refining process (i.e. before the mixture enters separator 16) because there is little contribution from the drying process. As such, the resulting dried fiber material contains a minimal amount of VOCs.

Good blending between resin and the fiber/steam mixture is achieved by creating conditions within relay pipe 26 that are substantially the same as conditions within blowline 12. Various design elements contribute to the conditions within relay pipe 26, including flow velocity, flow volume, pipe size, temperature, resin injection equipment configuration, and pipe geometry. Relay pipe 26 is essentially configured as a second blowline downstream of separator 16.

A relatively high flow velocity of the fiber material through relay pipe 26 provides for a high level of atomization of the resin, which results in excellent blending. The relatively high flow velocity through relay pipe 26 also helps to fluff the fiber, and minimizes clumping or balling of the fiber when adding resin. The higher the flow velocity, the better the atomization of the resin. Blower 32 helps to maintain a relatively high flow velocity. It should be understood that flow velocity may vary depending on the particular requirements and configuration of system 10. However, flow velocity is preferably at least about 100 feet per second, and may be as much as about 800 feet per second or more.

Figure 2:
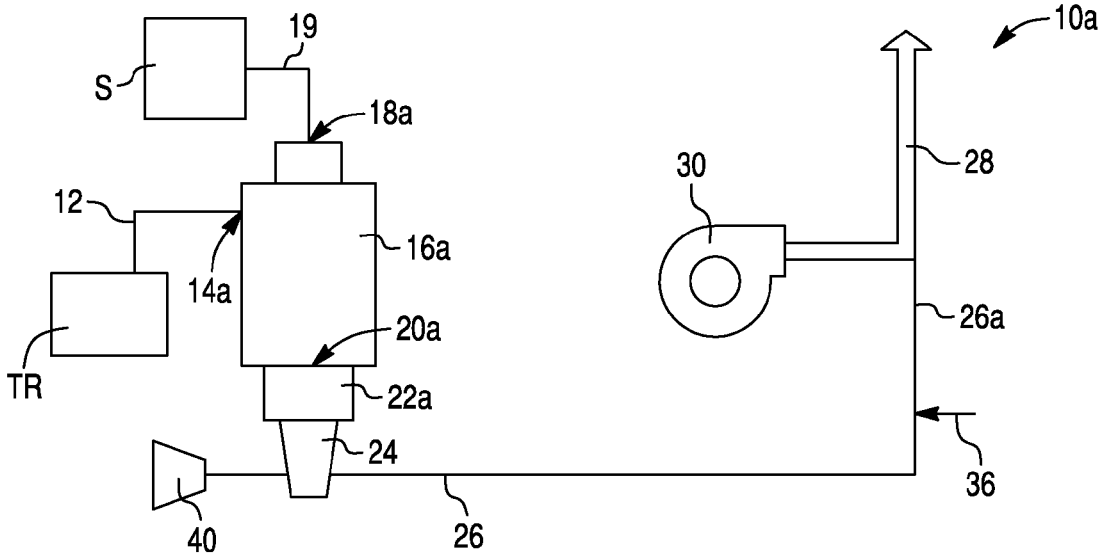
FIG. 2 is a schematic of a steam separation system according to another embodiment.

A steam separation system 10A according to a second embodiment is best shown in FIG. 2. Components of system 10A that are identical to components of system 10 are identified with like reference numerals. Thus, system 10A includes blowline 12 for transporting a mixture of fiber material and process steam produced from a conventional refiner, relay pipe 26, and dryer duct 28. However, system 10A does not include airlock 22. Rather, a plug screw feeder 22A is provided, which is in communication with a separator 16A. Separator 16A may be a non-pressurized separator, such as in the first embodiment, or a pressurized separator, such as a pressurized cyclone or a mechanical separator.

In a preferred configuration of system 10A, separator 16A is a mechanical separator, such as a mechanical steam separator manufactured by Metso Paper Inc. of Finland. Mechanical separators are known in the art, and generally have a lower percentage of fiber loss during steam separation compared to cyclones. However, current mechanical separators are typically not used in the board-making industry and thus do not have resin systems installed downstream.

Mechanical steam separator 16A includes inlet 14A where the refined fiber and steam enter separator 16A. Separator 16A centrifugally separates the steam from the fiber. The waste steam exits a waste steam outlet 18A. The dirty steam may then be processed by scrubber S, or disposed of via an incinerator or as liquid waste, as in the first embodiment. The separated fiber material then exits separator 16A through an exit portion 20A and through plug screw feeder 22A. Plug screw feeder 22A compresses the fiber material against an exit valve and excess steam is mechanically "squeezed" from the fiber material. The cleaned fiber material exits screw feeder 22A and into transition chamber 24, which is in communication with relay pipe 26. Material may be channeled therethrough even if separator 16A is pressurized. As such, the cleaned fiber may be easily channeled out of separator 16A and into relay pipe 26 for transport to dryer duct 28.

Proper functioning of plug screw feeder 22A is limited to a maximum pressure rating according to manufacturer specifications. Therefore, a screw feeder having the necessary pressure rating for a particular system should be used. Most conventional plug screw feeders are able to channel fiber material out of a pressurized separator, such as separator 16A, which may have an internal pressure of up to 100 psi or more. A suitable screw feeder 22A for an exemplary configuration of system 10A is manufactured by Metso Paper Inc. of Finland. However, any screw feeder having the requisite pressure rating for a particular configuration for system 10A may be used.

As in the first embodiment, the flow velocity within relay pipe 26 is preferably substantially the same as the flow velocity within blowline 12. As known in the art, flow velocity increases as pressure increases, given flow and pressures vary proportionately at a constant pipe diameter and length. Thus, to achieve the preferred flow velocity of at least about 100 feet per second, more preferably at least about 125 feet per second, it may be desirable to operate relay pipe 26 at higher pressures. Thusly, the pressure in relay pipe 26 is not limited to about 15 psi, as in the first embodiment, due to the use of plug screw feeder 22A. Therefore, a relatively high pressure may be maintained which allows for more design flexibility of relay pipe 26. A pressure sufficient to achieve the preferred flow velocity may be maintained by injecting clean steam into transition chamber 24 via a steam nozzle 40. As such, system 10A may not require blower 32 in order to achieve the preferred flow velocity.

Temperature within relay pipe 26 may also vary depending on the particular configuration of system 10A, but is typically at least about 212° F. or higher to prevent the steam from steam nozzle 40 from condensing into water.

Screw feeder 22A discharges cleaned fiber material into transition chamber 24 continuously during operation. The cleaned fiber material is forced through relay pipe 26 along with clean steam supplied by transition chamber 24. Screw feeder 22A prevents a substantial portion of the dirty steam, preferably at least about 80%, from passing into transition chamber 24. Screw feeder 22A continuously discharges cleaned fiber material into transition chamber 24 at a substantially uniform rate, which provides for a relatively uniform flow of fiber material through relay pipe 26. The cleaned fiber material is channeled through relay pipe 26 to dryer duct 28. As in the first embodiment, resin is added to the cleaned fiber material via resin line 36, mixed thoroughly, and then dried in dryer duct 28. VOC emissions are reduced by at least about 80%, more preferably at least about 90%.

Figure 3A:
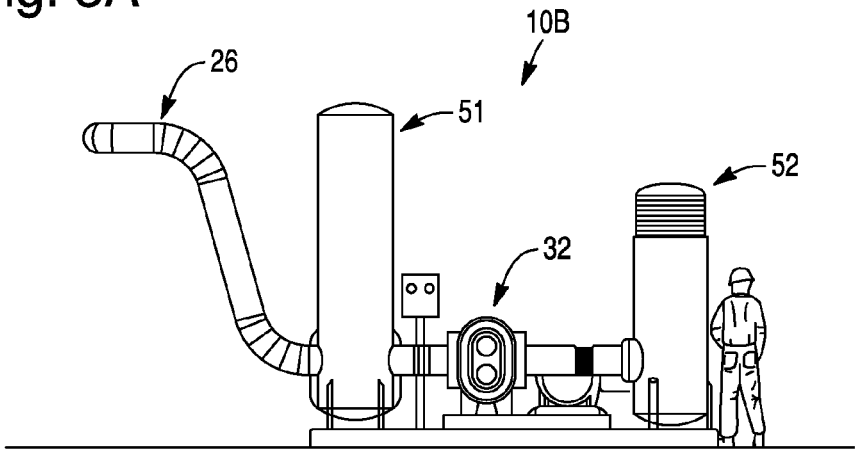
FIG. 3A is an elevational view of a portion of a steam separation system according to another embodiment.
Figure 3B:
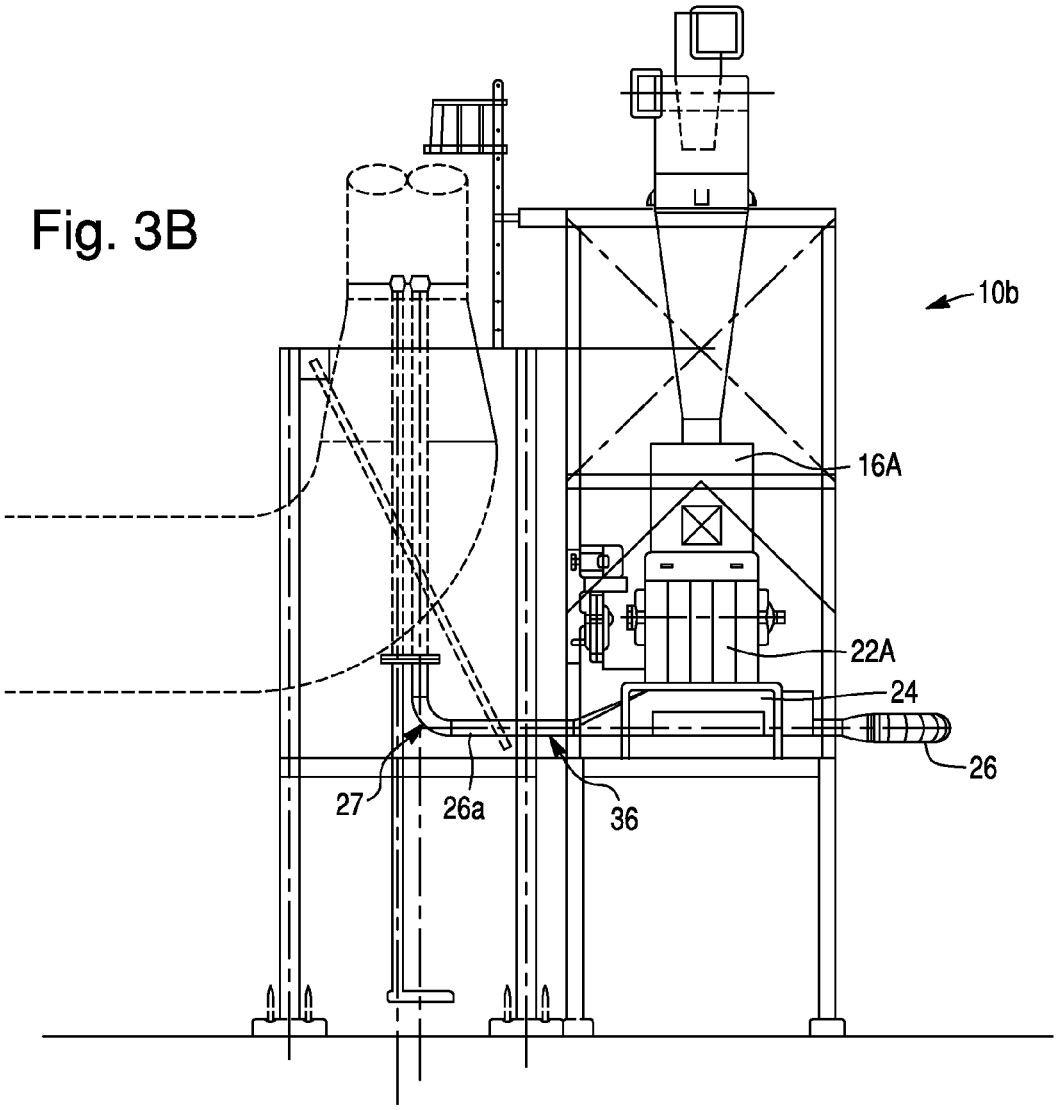
FIG. 3B is an elevational view of another portion of the steam separation system shown in FIG. 3A.
Figure 4:
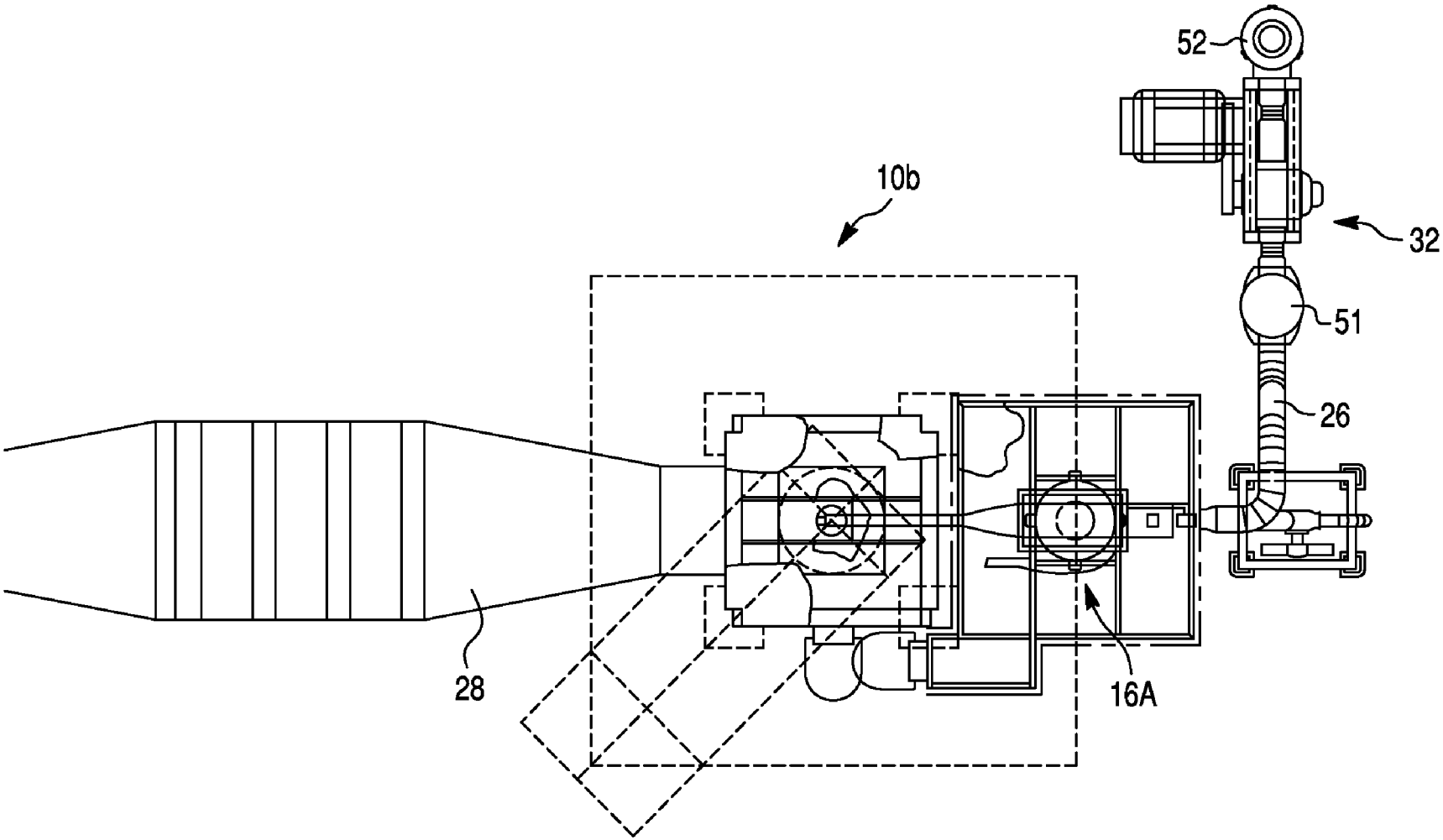
FIG. 4 is a plan view of the steam separation system shown in FIGS. 3A and 3B.

An exemplary configuration of steam separation system 10B according to a third embodiment is best shown in FIGS. 3A, 3B and 4. System 10B includes some components that are identical to components of the embodiments described above, and are identified with like reference numerals. As best shown in FIG. 3A, system 10B includes blower 32, silencer tanks S1, S2, and relay pipe 26. As known in the art, silencer tanks S1, S2 may be used with high power blowers, such as blower 32, to reduce noise produced therefrom. Blower 32 supplies air to relay pipe 26 as described above. A steam nozzle may also be provided that is in communication with relay pipe 26, so that a combination of air and steam are supplied to relay pipe 26 upstream of mechanical separator 16A.

As best shown in FIG. 3B, separator 16A is in communication with rotary airlock 22 and associated transition chamber 24 for feeding the cleaned fiber material into relay pipe 26. Resin is supplied to relay pipe 26 via resin line 36 at a point downstream of separator 16A. Preferably, a phenol-formaldehyde based resin is used. As in the other embodiments, flow velocity in relay pipe 26 is preferably at least about 100 feet per second, more preferably at least about 125 feet per second.

Relay pipe 26 preferably includes an elbow 27 of about 90° downstream of resin line 36. The impact of the resin/fiber mixture against the walls of elbow 27 in relay pipe 26 aids in blending the fiber with the resin because elbow 27 creates turbulence in the flow by requiring that the direction change. This turbulence helps to transfer resin from fiber to fiber. In addition, resin build-up on relay pipe 26 may be reduced due to flow turbulence created by elbow 27. The relatively high flow velocity also helps to minimize resin build-up on relay pipe 26. It should be understood that other means of creating turbulence may also be used instead of elbow 27. For example, relay pipe 26 may include internal mixing bars to create flow turbulence. As best shown in FIGS. 3B and 4, the mixed fiber/resin material is dried in dryer duct 28. Prior to entering dryer duct 28, the fiber and resin is channeled through a portion 26*a* of relay pipe 26 having a sufficient length to allow for the fiber and resin to be thoroughly mixed prior to drying.

Figure 5:
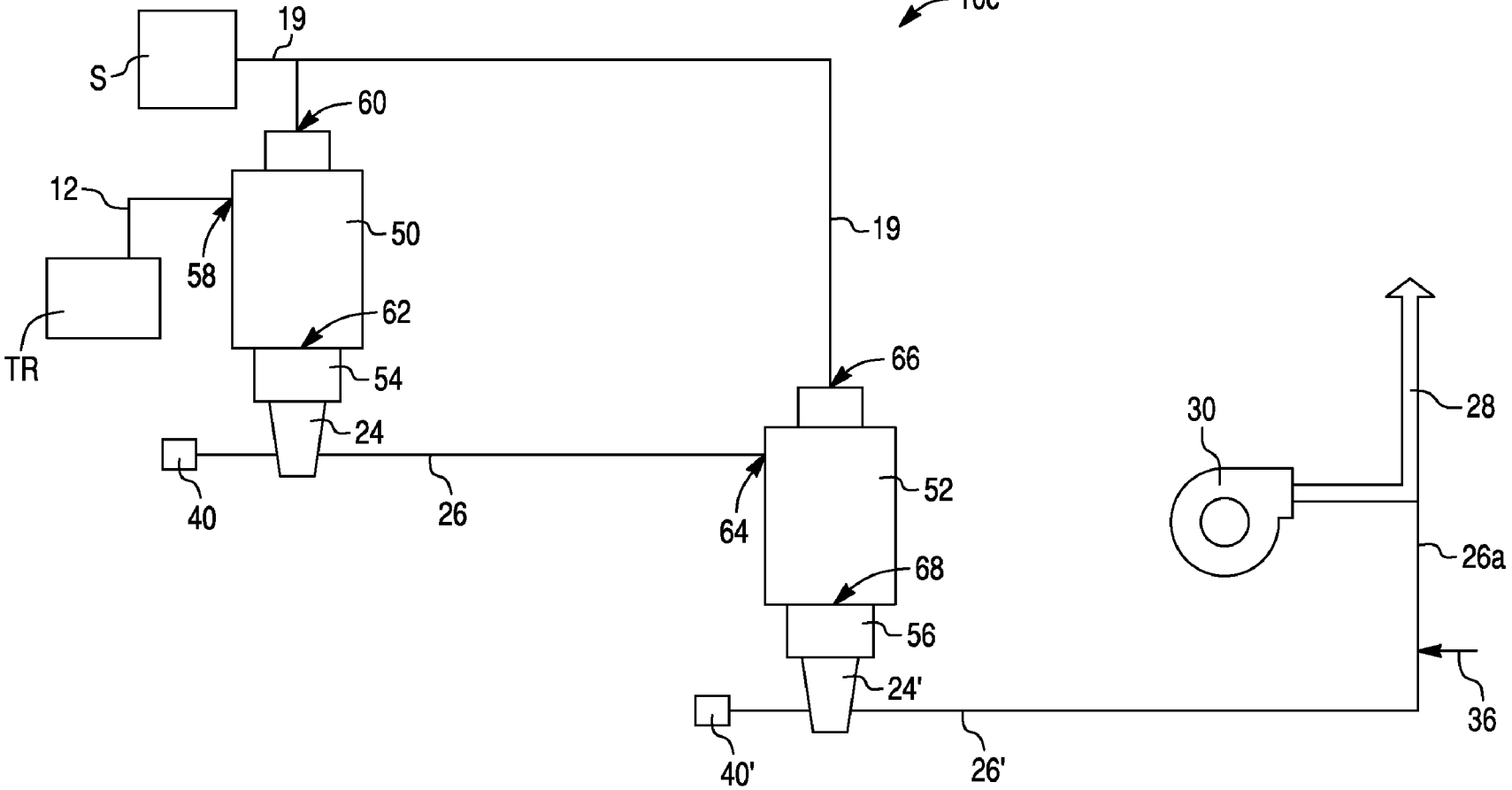
FIG. 5 is a schematic of a steam separation system according to another embodiment of the present invention.

A steam separation system 10C according to a fourth embodiment is best shown in FIG. 5. System 10C includes a first steam separator 50, as well as a second steam separator 52. Thus, cascading separators 50, 52 are provided for gradually reducing the dirty steam. Preferably, separators 50, 52 are cyclones or mechanical separators, which are in communication with plug screw feeders 54, 56, respectively.

Fiber is blown through blowline 12 and through an inlet 58 of separator 50. Waste steam is channeled out of separator 50 through a waste steam outlet 60, and may then be sent to a scrubber S via associated piping 19, or processed by an incinerator or condensed for processing. Separator 50 is in communication with screw feeder 54 via outlet 62. Screw feeder 54 preferably prevents at least about 50% of the dirty steam from passing therethrough into transition chamber 24, more preferably at least about 70%. Fiber is channeled through feeder 54 into transition chamber 24, and into relay pipe 26, as described above. Steam may be supplied to relay pipe 26 via steam nozzle 40. Alternatively, a blower and/or venturi system may be used.

The cleaned fiber material is channeled through relay pipe 26, preferably at a flow velocity of at least about 100 feet per second. Relay pipe 26 is in communication with a second inlet 64 of second separator 52. The cleaned fiber material is supplied to separator 52 from relay pipe 26 through inlet 64. Second separator 52 also includes a waste steam outlet 66, and an outlet 68 communicating with a second screw feeder 56. Second screw feeder 56 communicates with a second transition chamber 24', which is in communication with a second relay pipe 26'. Preferably, second screw feeder 56 prevents at least about 50% or more of the remaining waste steam from passing into second transition chamber 24'.

Cleaned fiber material is channeled through feeder 56 into transition chamber 24'. The cleaned fiber material is then supplied to relay pipe 26'. Additional clean steam may be added via a second steam nozzle 40'. The cleaned fiber material is transported through relay pipe 26' at a relatively high flow velocity, preferably at least about 125 feet per second. Resin is supplied to relay pipe 26' via resin line 36 at a point downstream of both separators 50, 52, and thoroughly mixed while traveling through a portion 26*a* of relay pipe 26 prior to entering dryer duct 28.

Preferably, the level of VOCs is reduced during the first separation stage by at least about 50%, more preferably at least about 75%. The level of VOCs is further reduced during the second separation stage, preferably by at least an additional 50% or more, so that a substantial reduction in VOC emission levels is achieved, preferably by at least about 80%, more preferably by at least about 90%.

Figure 6:
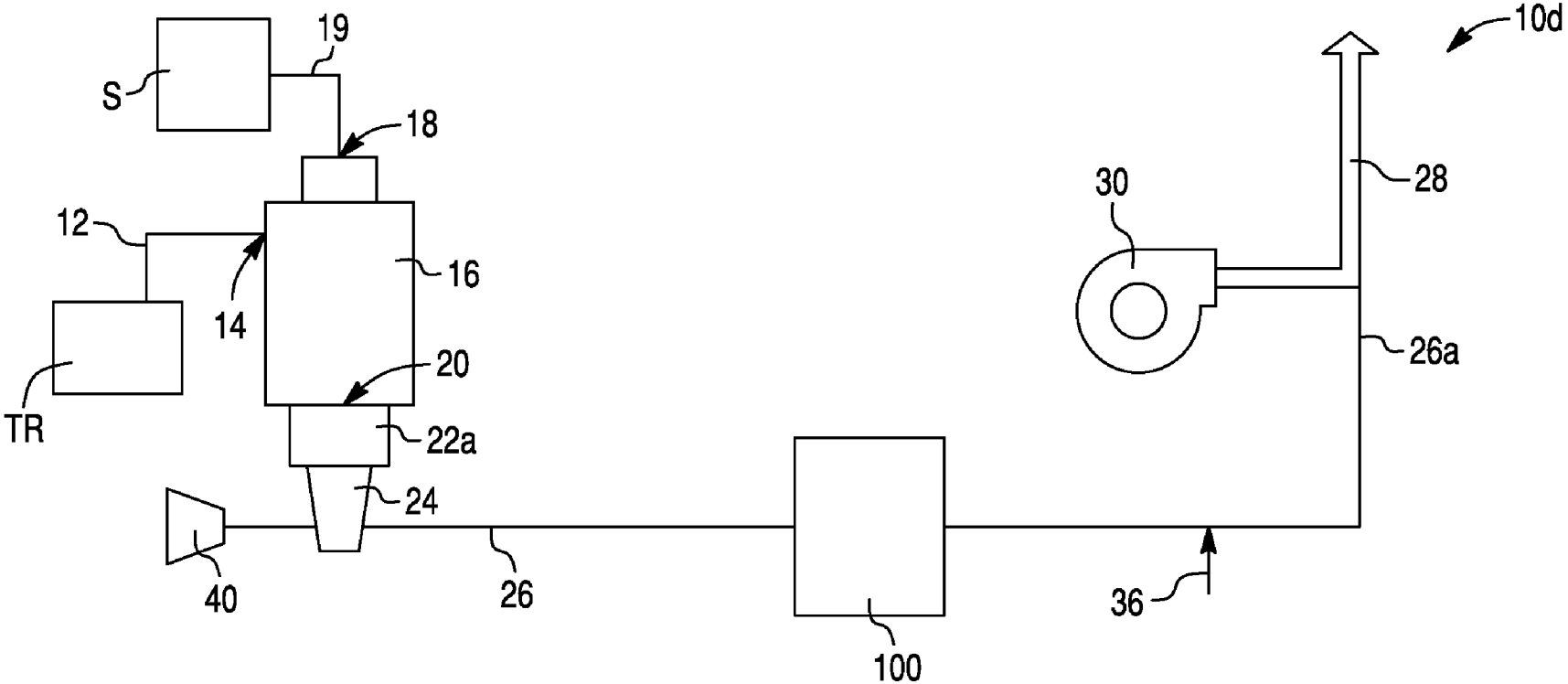
FIG. 6 is a schematic of a steam separation system according to another embodiment.

An exemplary configuration of steam separation system 10D according to a fifth embodiment is best shown in FIG. 6. System 10D includes some components that are identical to components of the embodiments described above, and are identified with like reference numerals.

System 10D preferably includes separator 16, which is preferably a non-pressurized cyclone as in the first embodiment. Cyclone 16 is relatively inexpensive compared to a mechanical separator. However, separator 16 is in communication with plug screw feeder 22A, as in the second embodiment. Feeder 22A supplies a relatively uniform flow of separated fiber material into transition chamber 24, and provides for higher levels of steam separation compared to airlock 22. Furthermore, screw feeder 22A provides for relatively flexible pressure operating parameters compared to airlock 22.

System 10D includes relay pipe 26, resin line 36, and dryer duct 28 as described above. System 10D may also include a fiber fluffing device 100 communicating with relay pipe 26. Fluffing device 100 is downstream of transition chamber 24, and preferably intermediate transition chamber 24 and resin line 36. Fluffing device 100 may include rotating discs or bars, which disrupt the flow of cleaned fiber material through relay pipe 26. Fiber material may clump as it is squeezed through screw feeder 22A. Fluffing device 100 ensures that any such clumps are fragmented prior to mixing with the resin via resin line 36. In this way, thorough mixing of the fiber and resin is achieved.

It should be understood that one of the embodiments described herein may be preferred depending on the particular configuration and application of the refining system. For example, high pressure blower 32 and airlock 22 may be preferred if a relatively short relay pipe 26 is utilized. However, screw feeder 22A may be preferred if a relatively long relay pipe 26 is utilized, which may require a relatively high pressure in order to achieve a relatively high flow velocity. A system having a screw feeder may also be preferred if equipment is readily available for providing such higher pressures and/or additional steam at little additional cost. It should also be understood that a steam separation system according to the present invention may include certain aspects from various embodiment described herein. For example, it may be desirable to include an elbow bend in the relay pipe for systems 10 or 10A or 10C. Thus, a steam separation system according to the present invention may include components of various embodiments described herein.

It will be apparent to one of ordinary skill in the art that various modifications and variations can be made in construction or configuration of the present invention without departing from the scope or spirit of the invention. Thus, it is intended that the present invention cover all such modifications and variations of the invention, provided they come with the scope of the following claims and their equivalents.

I claim as follows:

1. A method of reducing volatile organic compound (VOC) emissions generated during refining cellulosic fibrous material, comprising the steps of:

transporting a mixture of fiber material and process steam containing VOCs in a blowline at a first flow velocity into a steam separator;

discharging cleaned fiber material from the separator into a relay pipe while preventing a substantial portion of the process steam from passing into the relay pipe;

transporting the cleaned fiber material through the relay pipe at a second flow velocity white mixing the cleaned fiber material with a resin having low levels of VOCs; and drying the mixed cleaned fiber material and resin in a dryer duct.

2. The method of claim 1, wherein the first flow velocity is substantially the same as the second flow velocity.

3. The method claim 1, including the step of providing phenol-formaldehyde resin during said transporting and mixing step.

4. The method of claim 1, including the further step of maintaining an internal pressure within the relay pipe sufficient to achieve a flow velocity of at least about 100 feet per second.

5. A method of reducing volatile organic compound (VOC) emissions generated during refining cellulosic fibrous material, the method comprising the steps of:

receiving a mixture of fiber material and process steam containing VOCs into a steam separator;

cleaning the mixture to separate waste steam from cleaned fiber material and discharging the cleaned fiber material from the separator into a relay pipe;

transporting the cleaned fiber material through the relay pipe while mixing the cleaned fiber material with a resin having low levels of VOCs; and drying the mixed cleaned fiber material and resin in a dryer duct.

6. The method of claim 5, further comprising:

prior to receiving the mixture of fiber material and process steam into the steam separator, refining the fiber material in a thermomechanical refiner and providing the refined fiber material and steam produced in the refining process to the steam separator via a blowline.

7. The method of claim 5, further comprising:

prior to mixing the cleaned fiber material with the resin, fluffing the cleaned fiber material in the relay pipe to break up any existing clumps of the fiber material.

8. The method of claim 7, wherein the step of fluffing the cleaned fiber material comprises:

rotating a plurality of fluffing elements in the relay pipe to disrupt the flow of cleaned fiber material therethrough.

9. The method of claim 5, wherein the mixing of the cleaned fiber material with the resin comprises completely mixing the resin with the fiber material prior to entering the dryer duct.

10. The method of claim 5, wherein the step of discharging the cleaned fiber material into the relay pipe further comprises preventing a substantial portion of the process steam from passing into the relay pipe using a steam flow control mechanism located at an outlet of the steam separator.

11. The method of claim 10, wherein the preventing of the substantial portion of the process steam from passing into the relay pipe includes discharging the cleaned fiber into the relay pipe via one of a plug screw feeder and an airlock.

12. The method of claim 5, further comprising:

blowing a combination of air and clean steam into the relay pipe using a blower located near where the cleaned fiber material is discharged from the separator into the relay pipe.

13. The method of claim 12, wherein the blowing of the air and clean steam comprises blowing hot air and steam into the relay pipe, the hot air and steam being introduced into the relay pipe at a temperature of at least about 200° F.

14. The method of claim 5, further comprising:

injecting steam into the relay pipe via a steam nozzle to increase flow velocity of the relay pipe.

15. The method of claim 5, further comprising:

prior to mixing the cleaned fiber material with the resin, receiving the cleaned fiber material into a second steam separator; and performing a second cleaning operation to separate remaining waste steam from the cleaned fiber material and discharging the twice cleaned fiber material into the relay pipe.

* * * * *